US006609893B2

(12) United States Patent
Dobrzeniecki

(10) Patent No.: US 6,609,893 B2
(45) Date of Patent: Aug. 26, 2003

(54) IMPELLER WHEEL WITH AN IMPROVED CONNECTION BETWEEN THE CENTER PLATE AND THE FAN BLADES

(75) Inventor: Stanley A. Dobrzeniecki, Mentor, OH (US)

(73) Assignee: Morrison Products, Inc., Cleveland, OH (US)

( * ) Notice: Subject to any disclaimer, the term of this patent is extended or adjusted under 35 U.S.C. 154(b) by 53 days.

(21) Appl. No.: 10/032,719

(22) Filed: Dec. 28, 2001

(65) Prior Publication Data

US 2003/0123985 A1 Jul. 3, 2003

(51) Int. Cl.[7] ..... F04D 29/30
(52) U.S. Cl. ..... 416/187
(58) Field of Search ..... 416/178, 187, 416/184, 199; 415/98, 102

(56) References Cited

U.S. PATENT DOCUMENTS 3,578,878 A 5/1971 Ross
3,711,914 A 1/1973 Baker
4,515,527 A 5/1985 Baker
5,951,249 A * 9/1999 Aylor ..... 416/42
6,203,278 B1 * 3/2001 Mumpower ..... 416/178

* cited by examiner

*Primary Examiner*—Edward K. Look
*Assistant Examiner*—J. M. McAleenan
(74) *Attorney, Agent, or Firm*—Calfee, Halter & Griswold, LLP

(57) ABSTRACT

An impeller wheel includes a hub, a center plate affixed to and extending radially outwardly from the hub, and a plurality of fan blades connected to the center plate. The connection between the center plate and each fan blade includes two laterally spaced, angularly extending prongs on the center plate being tightly received in two laterally spaced and angularly extending wedge shaped receptacles in a fan blade notch to frictionally and mechanically secure each fan blade to the center plate. This connection joint can be used for any connection of a plate to another plate or to a blade and for any type of impeller.

17 Claims, 2 Drawing Sheets

IMPELLER WHEEL WITH AN IMPROVED CONNECTION BETWEEN THE CENTER PLATE AND THE FAN BLADES

FIELD OF THE INVENTION

The present invention relates generally to an improved connection between the center plate and fan blades of an impeller wheel and more specifically to two laterally spaced prongs on the base plate being respectively tightly received in two laterally spaced, wedge shape receptacles in a notch within each fan blade to form a frictional and mechanical connection therebetween.

BACKGROUND

One common system used to circulate air or other fluids includes a motor that rotates a shaft to which an impeller is attached. An exemplary center plate fan assembly, known as an impeller wheel or squirrel cage impeller, is shown in FIG. 1.

Impeller wheels typically include a hub, a center plate affixed to and extending radially outwardly from the hub and a plurality of fan blades connected to the center plate. The fan blades are usually equally circumferentially spaced about the center plate to form a "squirrel cage" assembly. These fan blades are connected to the radially outer edge of the center plate.

The prior art connection between the center plate and fan blades is shown in FIG. 5 and includes a rectangular or hourglass shape notch I in the radially lower edge 2 of each of the fan blades 3. The connection also includes bifurcated prongs 4A and 4B on the radially outer portion of the center plate, indicated generally at 6. During assembly, the prongs 4A and 4B are forced into the blind end corners of the notch 1 in fan blades 3 to create a frictional and mechanical connection joint. This joint is formed by the center plate prongs being deformed as they are respectively forced into the corners and along the opposed sides of the fan blade notch 1. As is apparent from FIG. 5, the ends of the prongs 4A and 4B engage the end of the notch I and the laterally outer sides of the prongs have limited engagement with the respective opposed sidewalls of the notch 1.

SUMMARY OF THE INVENTION

The present invention includes a notch that has a tongue provided on and extending inwardly from a portion of the end wall of the notch. The tongue cooperates with the end wall and sidewalls of the notch to form two wedge shaped, laterally spaced receptacles. The resultant notch has a generally M shaped configuration, with the wedge shape receptacles extending at equal but opposite angles relative to the centerline of the center plate.

The wedge shaped receptacles in the notch tightly receive the prongs on the center plate to form the connection joint. The wedge shaped receptacles are configured to provide a contact and interference fit with the center plate prongs inserted therein. The prongs deform as they are forced into the receptacles, and both sides of the prongs contact and interfere with the sidewalls of the wedge shaped receptacle. This engagement of the prongs on both sides thereof with the wedge shaped receptacles creates additional mechanical locking and friction not obtainable with the prior art rectangular or hour glass shaped notch, since the engagement on those notch designs is only on one side of the prong.

It is an object of the present invention to provide an improved connection between a plate and a blade.

It is a further object of the present invention to improve the connection between the center plate and fan blade of an impeller wheel to enhance its resistance to torsional operating forces.

It is yet another object of the present invention to provide a fan blade notch having two laterally spaced wedge shaped receptacles therein, which respectively tightly receive two laterally spaced prongs on the center plate of an impeller wheel. Both sides of each prong contact the converging sidewalls of the wedge shape receptacle to form an enhanced mechanical and frictional connection.

BRIEF DESCRIPTION OF THE FIGURES

In the accompanying figures, which are incorporated in and constitute a part of this specification, embodiments of the invention are illustrated, which, together with a general description of the inventions given above, and the detailed description given below, serve to illustrate the principals of this invention. The illustrated embodiments are not meant to limit the invention in such a way that simple modifications, such as those that could be made by one ordinarily skilled in the art, are not also within the scope and the spirit of the inventive concepts discussed and claimed herein.

DETAILED DESCRIPTION

According to the present invention, an improved connection is provided between a base plate and fan blade of a fan to provide an enhanced frictional and mechanical joint.

Figure 1:
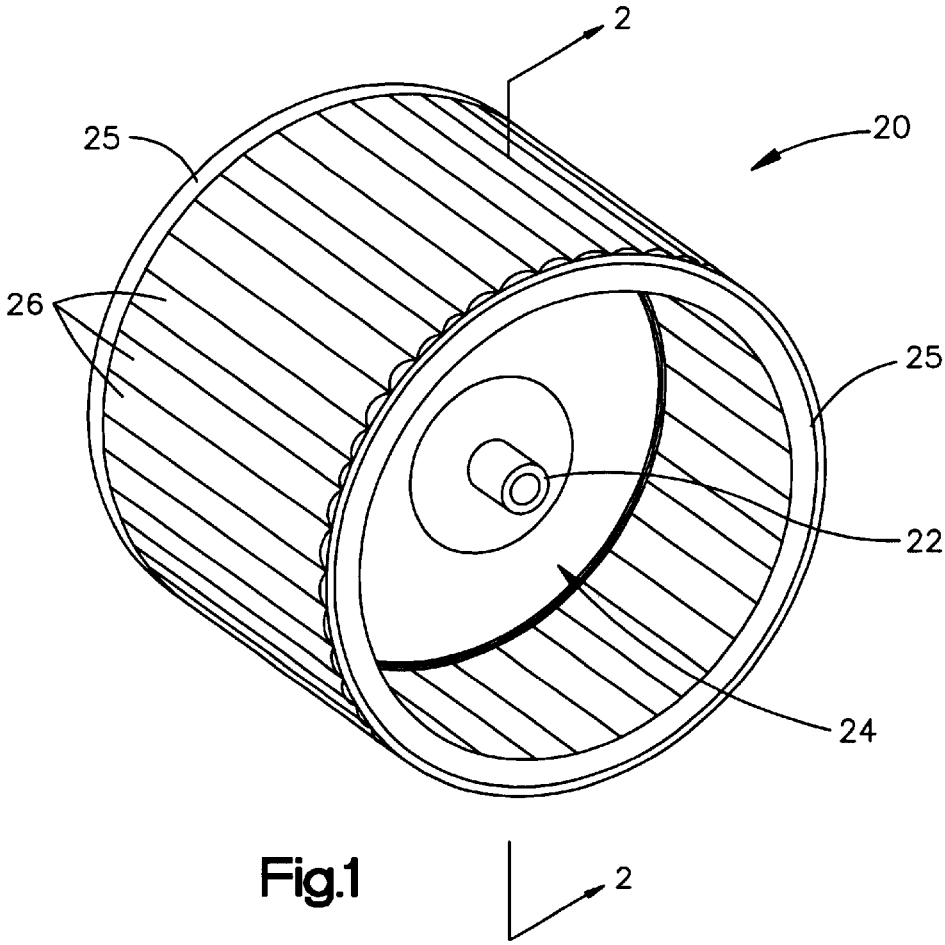
FIG. 1 is a perspective view of an impeller wheel of the present invention having a hub, a center plate and a plurality of fan blades.
Figure 2:
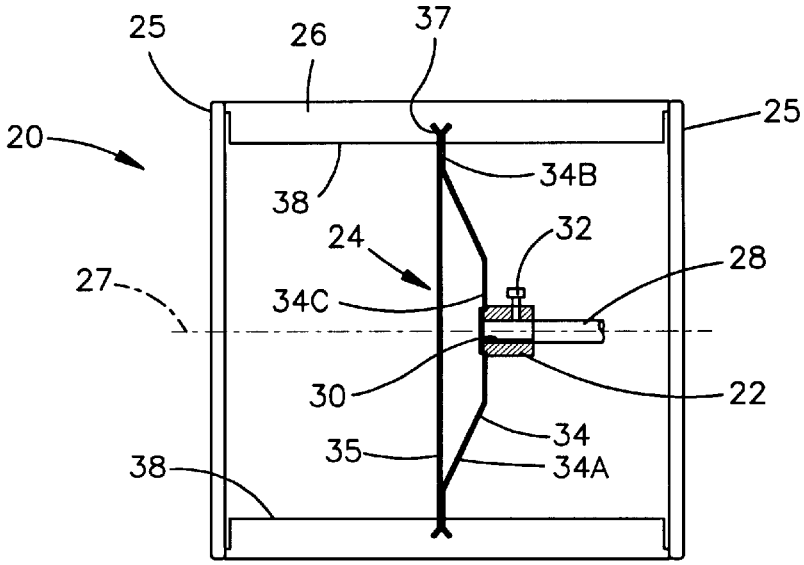
FIG. 2 is a vertical cross section of the impeller wheel of the present invention taken generally along the plane 2—2 in FIG. 1.

Referring initially to FIGS. 1 and 2 of the drawings, the impeller wheel of the present invention is identified generally by reference numeral 20. The impeller wheel 20, known as a "squirrel cage" impeller, includes a hub 22, a center plate, indicated generally at 24, and a plurality of fan blades 26. The fan blades 26 are generally parallel with one another and also generally parallel to the center axis 27 of the impeller wheel 20. The individual blades 26 are usually evenly circumferentially spaced around and connected to the outer edge of the center plate. The ends of the fan blades 26 can be interconnected and thus stabilized by circular retention rings 25. As best shown in FIG. 1, each of the fan blades 26 is curved and/or slightly angled approximately the same amount (relative to a tangent to the circular center plate) to produce the desired air circulation when the impeller wheel rotates.

To that end, a drive shaft 28 is received within the bore 30 of hub 22 and is secured thereto by a set screw 32. The drive shaft 28 is directly or indirectly coupled to a motor (not shown). When the motor is operated to rotate the drive shaft 28, the impeller wheel 20 rotates about central axis 27 to allow the fan blades 26 to produce the desired air circulation.

An impeller wheel 20 of this type is often employed in furnaces, air conditioners and a wide variety of other HVAC equipment.

Turning now in more detail to FIG. 2, the center plate 24 as shown includes an assembly of two discs 34 and 35. Disc 34 includes a frusto conical center portion 34A and an annular circumferential outer flange 34B. The hub 22 is mounted to the flat wall 34C of the frusto conical portion 34A of disc 34. The hub could also be integrally formed with the disc 34. As is apparent from FIG. 2, the center plate 24 is affixed to and extends radially outwardly from the hub 22. The radially outer circumferential portion of the discs 34 and 35 of the center plate 24 are received in and connected to notches 37 formed in the radially inner edges 38 of each of the fan blades 26.

Figure 3:
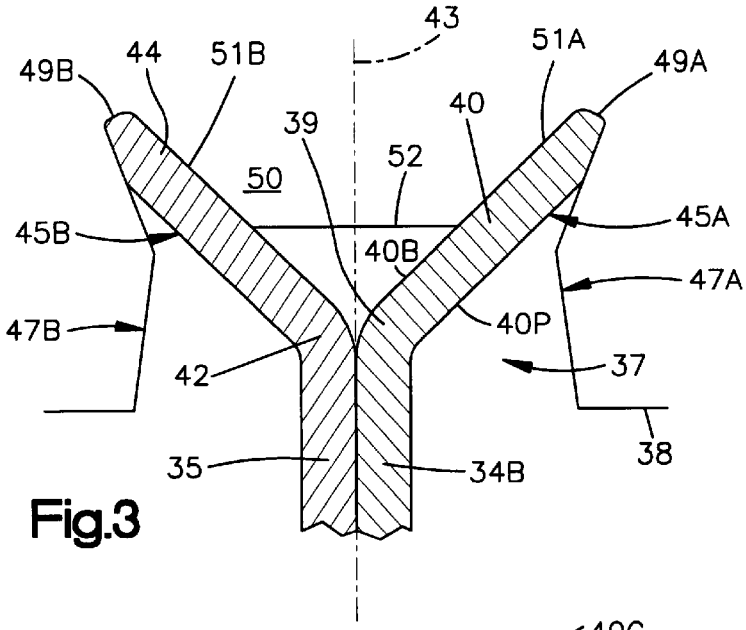
FIG. 3 is an enlarged cross section of the assembled connection between the center plate and fan blade of the impeller wheel of the present invention.
Figure 4:
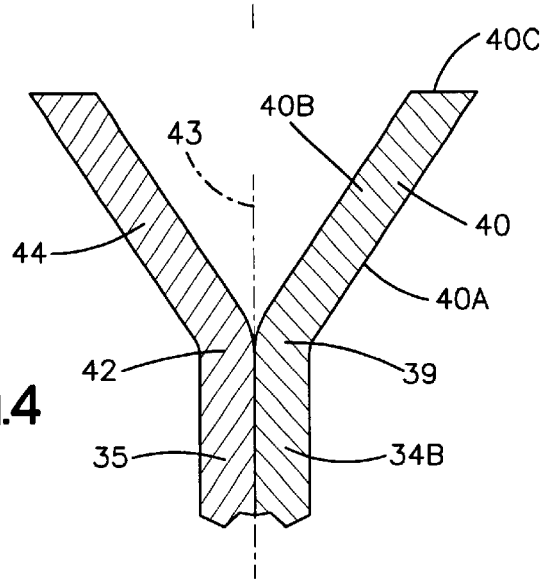
FIG. 4 is an elevation of the center plate prongs of the present invention prior to insertion in the wedge shaped receptacles.

As best shown in FIG. 3, the radially outer portion of the annular flange 34B of disc 34 is bent at 39 to form an angularly extending annular prong 40. Similarly, the radially outer portion of disc 35 of center plate 24 is bent at 42 to form an angularly extending annular prong 44. The bends at 39 and 42 are of substantially the same angle but in generally opposite directions relative to centerline 43 of center plate 24 to form bifurcated annular prongs 40 and 44 extending angularly away from one another as best shown in FIG. 3. As best shown in FIG. 4, the prongs 40 and 44 each have straight sides and a flat end prior to the connection being assembled. When assembled, the prongs 40 and 44 are deformed and are respectively tightly received in wedge shape recesses 45A and 45B formed within notch 37.

The notch 37 includes two opposed and oppositely facing generally V-shape sidewalls, indicated generally at 47A and 47B. The apices of the opposed generally V-shape sidewalls 47A and 47B are the closest together portions thereof. The radially outer ends of both sidewalls 47A and 47B are respectively provided with radii 49A and 49B in the end wall of the notch 37. Extending between the radii 49A and 49B is a tongue portion of the notch, identified generally at 50. The tongue 50 extending inwardly from the end wall of the notch is shaped like a truncated triangle, having converging angled sides 51A and 51B interconnected by a flat portion 52. The generally V shaped sidewalls 47A and 47B, radii 49A and 49B and tongue 50 cooperatively define a notch 37 having a generally M shaped configuration.

The sidewall 47A, radius 49A and side 51A of tongue 50 cooperate to define the wedge shaped receptacle 45A within notch 37. Similarly, sidewall 47B, radius 49B and side 51B of tongue 50 cooperate to define the wedge shape receptacle 45B. As is apparent from FIG. 3, the width of each of the wedge shape receptacles progressively decreases or converges as you advance radially outwardly therealong. The two wedge shape receptacles 45A and 45B are laterally spaced and angularly extend away from one another at equal but opposite angles relative to the radial centerline of the notch 37.

Figure 5:
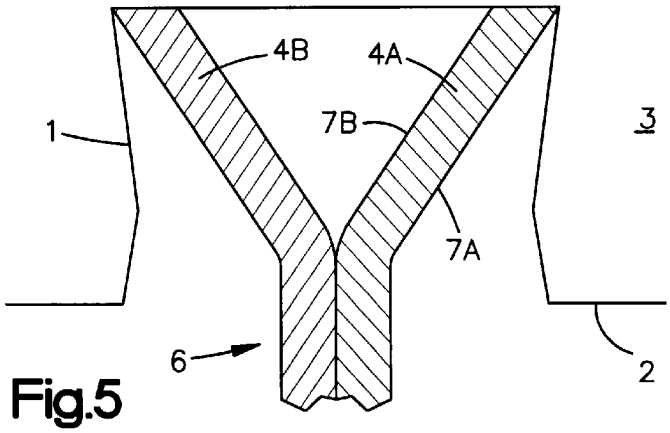
Fig.5 (PRIOR ART)
FIG. 5 is a cross section similar to FIG. 3 showing the assembled connection between the center plate and fan blade of the prior art impeller wheel.

In mounting a fan blade 26 on center plate 24, the prongs 40 and 44 are respectively forced into wedge shaped receptacles 45A and 45B. The prongs 40 and 44 are deformed in such forceful insertion so that both sides of the prongs contact the wedge shaped receptacle sides and the ends of the prongs contact the radius at the ends of the respective wedge shape receptacles. The deformation of the prongs 40 and 44 during assembly is readily seen by comparing the shape of the prongs as assembled in FIG. 3 to the shape of the prongs prior to assembly in FIG. 4. As thus assembled, the prongs 40 and 44 are tightly received within the wedge shaped receptacles 45A and 45B with increased mechanical and frictional contact. The annular prongs 40 and 44 are also deformed between each of the respective fan blades 26 on the impeller wheel 20 further to lock the fan blades in place. As is apparent from comparing FIG. 3 to FIG. 5, the surface contact between each of the prongs 40 and 44 and each wedge shaped receptacle 45A and 45B is greater than the surface contact between prongs 4A and 4B with notch 1 of the prior art connection.

Specifically, taking prong 40 as an example, it contacts wedge shaped receptacle 45A on both its laterally outer and inner sides 40A and 40B, respectively, as well as at its end wall 40C. By way of comparison in FIG. 5, the laterally outer side 7A of the flange 4A contacts a limited portion of the sidewall of notch 1, while the laterally inner side 7B of the flange 4A is not in contact with any surface. By increasing the amount of frictional and mechanical contact in the present invention, the connection between the center plate assembly 24 fan and blade 26 is better able to withstand over time the torsional forces experienced as a result of impeller wheel rotation. The enhanced connection will thus have greater operational life and efficiency than the prior art connection illustrated in FIG. 5.

While the preferred embodiment of an impeller wheel has been described, variations on that embodiment will occur to one of ordinary skill in the art. For example, the receptacles and/or prongs could be geometrically differently configured than that shown to also accomplish the enhanced surface and frictional contact of the present invention. Similarly, the center plate 24, shown as an assembly of two discs, could be made as a single plate having two annular bifurcated prongs at its radially outer end. The center plate could also be positioned slightly away from the center of the impeller wheel depending upon the configuration of the fan blades.

I claim:

1. An impeller wheel comprising:

a hub;

a center plate affixed to the hub and extending generally radially from said hub, said center plate having two laterally spaced prongs at its outer circumference, and a plurality of fan blades secured to the center plate, each of said fan blades having a notch with two laterally spaced receptacles therein respectively tightly receiving the prongs on the center plate to mechanically and frictionally secure each prong to its respective receptacle; wherein each receptacle is wedge with the wedge shape contracting as it progresses radially outwardly.

2. The impeller wheel according to claim 1 wherein the center plate includes two discs having their respective radially outer ends bent away from one another to form two annular, angularly extending prongs.

3. The impeller wheel according to claim 1 wherein each assembled prong is deformed and contacts its wedge shape receptacle along both of its sides and at its end.

4. The impeller wheel according to claim 1 wherein the fan blades are also interconnected at their outer ends by two spaced circular retention rings.

5. The impeller wheel according to claim 1 wherein the notch has a tongue extending between and cooperating to define the two wedge shape receptacles, the tongue constituting a generally truncated triangle.

6. The impeller wheel according to claim 5 wherein each notch has oppositely facing generally V shape side walls which cooperate with the tongue to define the two wedge shaped receptacles.

7. The impeller wheel according to claim 6 wherein the generally V shape sidewalls and tongue cooperate to define an M shaped notch.

8. The impeller wheel according to claim 1 wherein the radially outer ends of each wedge shaped receptacle are radiused.

9. The impeller wheel according to claim 1 wherein the prongs are annular and deformed between the fan blades.

10. An impeller wheel comprising:

a center plate assembly having two discs, the radially outer portions of said discs being bent in opposite angular directions to form two angularly extending annular prongs and a plurality of fan blades connected to said center plate, each of said fan blades having a notch formed in a radially inner edge thereof, the notch having two laterally spaced and oppositely angularly extending wedge shape receptacles therein respectively to tightly receive the two prongs therein to provide surface contact between the prongs and wedge shape receptacle along both sides and end of each of the prongs.

11. The impeller wheel according to claim 10 wherein each notch has oppositely facing generally V shape sidewalls and an inwardly extending tongue on an end wall, the generally V shape sidewalls and tongue cooperatively defining the wedge shaped receptacles.

12. The impeller wheel according to claim 11 wherein the tongue has a truncated triangular configuration.

13. The impeller wheel according to claim 10 wherein the prongs are deformed both within the wedge shape receptacles and circumferentially between the fan blades.

14. A connection between a plate and a blade comprising:

the plate at its outer end having two spaced, angularly extending prongs bent away from one another;

the blade having a notch formed therein, the notch having two laterally spaced wedge shaped receptacles angularly extending away from one another;

the prongs after assembly being tightly received in the wedge shaped receptacles, with each prong contacting the wedge shaped receptacle along both of its sides and at its end to frictionally and mechanically secure the plate and blade together.

15. The connection according to claim 14 wherein the notch has two oppositely facing generally V shaped sidewalls and an inwardly extending tongue at its end, the V shape sidewalls and tongue cooperating to define the wedge shaped receptacles.

16. The connection according to claim 15 wherein the tongue has a truncated triangular configuration.

17. The connection according to claim 14 wherein the prongs when assembled are deformed within the wedge shape receptacles.

* * * * *